US005764268A

United States Patent [19]

Bills et al.

[11] Patent Number: 5,764,268

[45] Date of Patent: Jun. 9, 1998

[54] APPARATUS AND METHOD FOR PROVIDING DONOR-RECEPTOR CONTACT IN A LASER-INDUCED THERMAL TRANSFER PRINTER

[75] Inventors: Richard E. Bills, Woodbury; Lawrence M. Lucking, Hugo, both of Minn.

[73] Assignee: Imation Corp., Oakdale, Minn.

[21] Appl. No.: 504,331

[22] Filed: Jul. 19, 1995

[51] Int. Cl.[6] ..... B41J 2/47

[52] U.S. Cl. ..... 347/213; 347/264; 347/262

[58] Field of Search ..... 347/262, 264, 347/213

[56] References Cited

U.S. PATENT DOCUMENTS

| | | | |
|---|---|---|---|
| 3,945,318 | 3/1976 | Landman | 101/467 |
| 4,245,003 | 1/1981 | Oransky et al. | 428/323 |
| 4,334,770 | 6/1982 | Landsman | 355/104 |
| 4,385,302 | 5/1983 | Moriguchi et al. | 346/76 PH |
| 4,388,628 | 6/1983 | Moriguchi et al. | 346/76 PH |
| 4,408,212 | 10/1983 | Moriguchi et al. | 346/76 PH |
| 4,442,452 | 4/1984 | Kurata et al. | 358/75 |
| 4,471,362 | 9/1984 | Murayama et al. | 346/76 PH |
| 4,638,372 | 1/1987 | Leng et al. | 358/296 |
| 5,009,509 | 4/1991 | Matoushek | 346/138 |
| 5,053,791 | 10/1991 | Baek et al. | 346/138 |
| 5,159,352 | 10/1992 | Ferla et al. | 346/108 |
| 5,218,380 | 6/1993 | Fiscella | 346/136 |
| 5,355,795 | 10/1994 | Moss et al. | 101/141 |
| 5,446,477 | 8/1995 | Baek et al. | 347/264 |

FOREIGN PATENT DOCUMENTS

| | | | |
|---|---|---|---|
| A-0 350 195 | 1/1990 | European Pat. Off. . | |
| A-0 529 562 | 3/1993 | European Pat. Off. . | |
| 0 542 544 A2 | 5/1993 | European Pat. Off. | B41J 2/475 |
| 6-106760 | 4/1994 | Japan | B41J 2/35 |
| WO 91/08904 | 6/1991 | WIPO | B41J 2/475 |
| WO 94/04365 | 3/1994 | WIPO | B41J 2/46 |

*Primary Examiner*—Mark J. Reinhart
*Attorney, Agent, or Firm*—Steven J. Shumaker

[57] ABSTRACT

An apparatus and method for providing contact between a donor sheet and a receptor sheet in a laser-induced thermal transfer printer make use of a support means for supporting a receptor sheet, means for mounting a donor sheet proximal to the receptor sheet over the support means, and means for applying tension to the donor sheet to draw the donor sheet into contact with the receptor sheet. The means for mounting the donor sheet and applying tension may be a clamp mechanism mounted on the support means. The clamp mechanism has a first clamp for holding a first end of the donor sheet and a second clamp for holding a second end of the donor sheet. The second clamp is movable relative to the first clamp to apply tension to the donor sheet, thereby drawing the donor sheet into contact with the receptor sheet.

26 Claims, 5 Drawing Sheets

APPARATUS AND METHOD FOR PROVIDING DONOR-RECEPTOR CONTACT IN A LASER-INDUCED THERMAL TRANSFER PRINTER

FIELD OF THE INVENTION

The present invention relates generally to laserinduced thermal transfer printing technology and, more particularly, to techniques for providing contact between a donor and receptor in a laser-induced thermal transfer printer.

DISCUSSION OF RELATED ART

Laser-induced thermal transfer printing involves the transfer of a material from a donor sheet to a receptor sheet to form a representation of an image on the receptor sheet. During transfer, the donor sheet and receptor sheet are held in contact with one another. The transfer of material is thermally induced by the application of a scanning laser beam at selected points across the donor-receptor combination. Laser-induced thermal transfer printing is useful in the production of halftone color proofs, films, and printing plates.

The donor sheet and receptor sheet must be held with uniform contact pressure across the donor-receptor combination to ensure uniform transfer characteristics for a given level of laser energy. Existing laser-induced thermal transfer printers use a vacuum drum to achieve sufficiently uniform contact between the donor sheet and receptor sheet. Examples of commercially available laser-induced thermal transfer printers using vacuum drums are the Kodak Approval™digital color proofer and the Crosfield Datrax™imagesetter.

Unfortunately, the need for a vacuum drum adds cost, size, and complexity to the printer. Thermal dye diffusion printers achieve vacuumless contact between the donor sheet and the receptor sheet to transfer colorant. In a thermal dye diffusion printer, a thermal head applies a significant amount of contact pressure between the donor sheet and receptor sheet, eliminating the need for a vacuum drum. In existing laser-induced thermal transfer printers, however, vacuum-assisted contact continues to be a necessity. In view of the cost, size, and complexity presented by a vacuum drum, there is a need for a laser-induced thermal transfer printer capable of achieving vacuumless contact between the donor sheet and the receptor sheet.

SUMMARY OF THE INVENTION

The present invention is directed to an apparatus and method for providing contact between a donor sheet and a receptor sheet in a laser-induced thermal transfer printer without the need for a vacuum drum. The present invention also is directed to a laser-induced thermal transfer printer having such an apparatus. By eliminating the need for a vacuum drum, the apparatus, method, and printer of the present invention significantly reduce the cost, size, and complexity of a laser-induced thermal transfer printer.

In a first embodiment, the present invention provides an apparatus for providing contact between a donor sheet and a receptor sheet in a laser-induced thermal transfer printer, the apparatus comprising a support means for supporting a receptor sheet, means for mounting a donor sheet proximal to the receptor sheet over the support means, and means for applying tension to the donor sheet to draw the donor sheet into contact with the receptor sheet.

In a second embodiment, the present invention provides an apparatus for providing contact between a donor sheet and a receptor sheet in a laser-induced thermal transfer printer, the apparatus comprising a support means for supporting a receptor sheet, and a clamp mechanism mounted on the support means, the clamp mechanism having a first clamp for holding a first end of a donor sheet and a second clamp for holding a second end of the donor sheet, wherein the clamp mechanism mounts the donor sheet proximal to the receptor sheet over the support means, and wherein the first clamp holds the first end of the donor sheet in a fixed position, and the second clamp is movable to apply a pulling tension to the second end of the donor sheet, thereby drawing the donor sheet into contact with the receptor sheet.

In a third embodiment, the present invention provides a method for providing contact between a donor sheet and a receptor sheet in a laser-induced thermal transfer printer, the method comprising the steps of supporting a receptor sheet on a support means, mounting a donor sheet proximal to the receptor sheet over the support means, and applying tension to the donor sheet to draw the donor sheet into contact with the receptor sheet.

In a fourth embodiment, the present invention provides a method for providing contact between a donor sheet and a receptor sheet in a laser-induced thermal transfer printer, the method comprising the steps of supporting a receptor sheet with a support means, providing a clamp mechanism mounted on the support means, the clamp mechanism having a first clamp and a second clamp, holding a first end of the donor sheet with the first clamp, holding a second end of the donor sheet with the second clamp, the clamp mechanism thereby mounting the donor sheet proximal to the receptor sheet over the support means, holding the first end of the donor sheet in a fixed position with the first clamp, and moving the second clamp to apply pulling tension to the donor sheet, thereby drawing the donor sheet into contact with the receptor sheet.

In a fifth embodiment, the present invention provides a laser-induced thermal transfer printer having an apparatus for providing contact between a donor sheet and a receptor sheet, the printer comprising a support means for supporting a receptor sheet, means for mounting a donor sheet proximal to the receptor sheet over the support means, means for applying tension to the donor sheet to draw the donor sheet into contact with the receptor sheet, a laser for inducing thermal transfer of donor material from the donor sheet to the receptor sheet to form an image on the receptor sheet.

In a sixth embodiment, the present invention provides a laser-induced thermal transfer printer including an apparatus for providing contact between a donor sheet and a receptor sheet, the printer comprising a support means for supporting a receptor sheet, a clamp mechanism mounted on the support means, the clamp mechanism having a first clamp for holding a first end of a donor sheet and a second clamp for holding a second end of the donor sheet, wherein the clamp mechanism mounts the donor sheet proximal to the receptor sheet over the support means, and wherein the first clamp holds the first end of the donor sheet in a fixed position, and the second clamp is movable to apply a pulling tension to the second end of the donor sheet, thereby drawing the donor sheet into contact with the receptor sheet, and a laser for inducing thermal transfer of donor material from the donor sheet to the receptor sheet to form an image on the receptor sheet.

In a seventh embodiment, the present invention provides an apparatus for providing contact between a donor sheet and a receptor sheet in a laser-induced thermal transfer printer, the apparatus comprising a support means for supporting a donor sheet, means for mounting a receptor sheet proximal to the donor sheet over the support means, and means for applying tension to the receptor sheet to draw the receptor sheet into contact with the donor sheet.

The advantages of the apparatus, method, and printer of the present invention will be set forth in part in the description that follows, and in part will be apparent from the description, or may be learned by practice of the present invention. The advantages of the apparatus, method, and printer of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
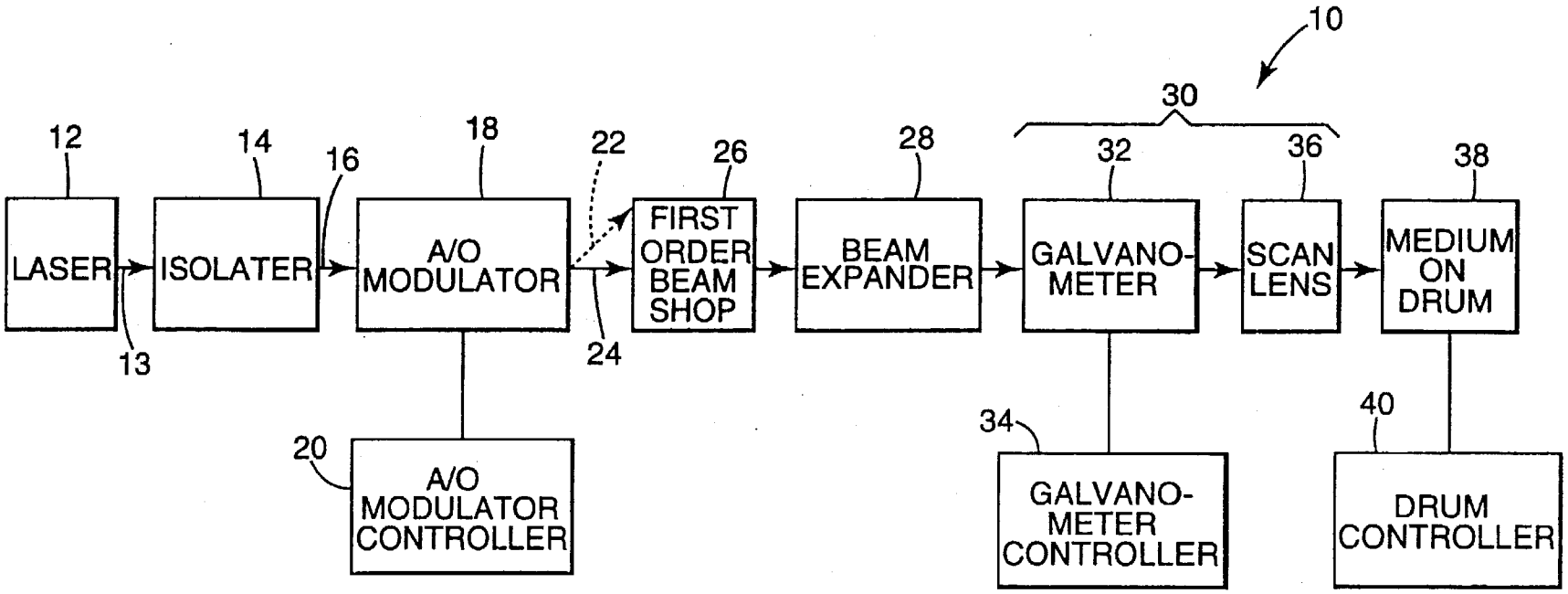
FIG. 1 is a functional block diagram of an exemplary laser-induced thermal transfer printer.

FIG. 1 is a functional block diagram of an exemplary laser-induced thermal transfer printer 10.

An example of a laser-induced thermal transfer printer conforming substantially to printer 10 of FIG. 1 is disclosed in copending and commonly assigned U.S. patent application Ser. No.08/324,728, of Richard E. Bills, entitled "ABLATION-TRANSFER-IMAGING USING ZERO ORDER LASER BEAMS IN A FLAT-FIELD SCANNER," the entire content of which is incorporated herein by reference. The printer 10 of FIG. 1 is shown for purposes of example only, as an illustration of a system with which the present invention could be used.

As shown in FIG. 1, printer 10 includes a laser 12 that generates a beam 13 of coherent light. The beam 13 passes through an isolator 14 to produce beam 16. The isolator 14 prevents back reflection from entering the cavity of laser 12. An acousto-optical modulator 18 receives beam 16 from isolator 14. An acousto-optical modulator controller 20 controls the mode of operation of modulator 18. In a first mode, modulator 18 produces a beam 22 of attenuated intensity. In a second mode, modulator 18 produces a substantially unattenuated beam 24. The controller 20 can be made to control modulator 18 to vary the intensity of the laser beam for transmission to a flat-field imaging scanner. Additional details concerning the operation of modulator 18 are provided in above-identified U.S. patent application Ser. No.08/324,728 now abandoned.

As further shown in FIG. 1, printer 10 includes a first order beam stop 26 that blocks light diffracted by modulator 18 to prevent transmission of diffracted light to the imaging medium. A beam expander 28 receives the light produced by beam stop 26, and controls the size of the light beam. A scanning system 30 scans the laser beam produced by beam expander 28 for application to the imaging medium. The scanning system 30 includes a galvanometer 32, a galvanometer controller 34, and a scan lens 36. The galvanometer controller 34 controls galvanometer 32 to scan the laser beam across the imaging medium. The scan lens 36 focuses the scanned laser beam, and applies the laser beam to the imaging medium. The imaging medium comprises a receptor sheet supported by a support means, such as a cylindrical drum 38. A donor sheet is mounted about drum 38 in contact with the receptor sheet. A drum controller 40 controls revolution of drum 38. The donor sheet carries material that, when heated by the scanned laser beam, transfers to the receptor sheet to form a representation of an image.

Figure 2:
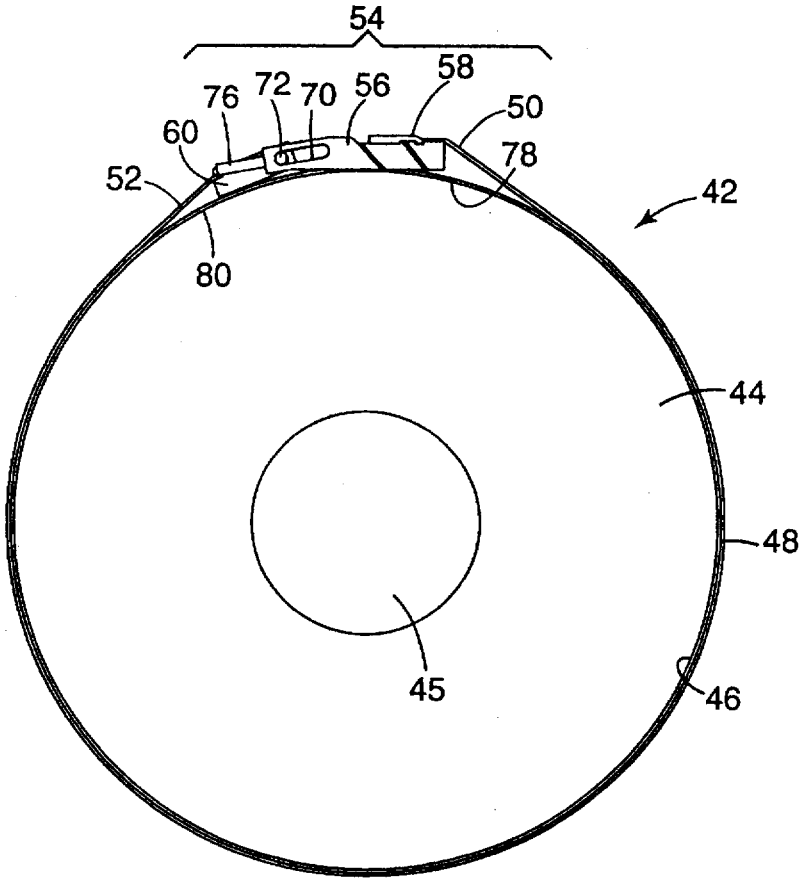
FIG. 2 is an end view of an apparatus for holding a donor sheet and a receptor sheet in contact with one another, in accordance with the present invention.

FIG. 2 is an end view of an apparatus 42 for holding a donor sheet and a receptor sheet in contact with one another, in accordance with the present invention. The apparatus 42 can be used in a laserinduced thermal transfer printer such as printer 10 of FIG. 1. The apparatus 42 includes a support means for supporting a receptor sheet 46. As shown in FIG. 2, for example, the support means may include a cylindrical drum 44 mounted about a rotor shaft 45. The cylindrical drum 44 supports receptor sheet 46 about a circumferential surface of the drum. The apparatus 42 further includes means for mounting a donor sheet 48 proximal to receptor sheet 46 about the circumferential surface of cylindrical drum 44, and means for applying tension to the donor sheet to draw the donor sheet into contact with the receptor sheet.

Alternatively, if receptor sheet 46 were transparent, the arrangement shown in FIG. 2 could be reversed, if desired. In other words, cylindrical drum 44 readily could be made to support donor sheet 48 about the circumferential surface of the drum. The transparent receptor sheet 46 then could be mounted proximal to donor sheet 48 about the circumferential surface of drum 44, and the tension applying means could be applied to the receptor sheet to draw the receptor sheet into contact with the donor sheet. In the remainder of this disclosure, for purposes of example, the present invention will be described with respect to the mounting of donor sheet 48 over receptor sheet 46.

The tensioning means of apparatus 42 includes means for applying pulling tension to at least one of a first end 50 of donor sheet 48 and a second end 52 of the donor sheet. In other words, the tensioning means applies pulling tension to either first end 50 or second end 52 of donor sheet 48. In the embodiment shown in FIG. 2, apparatus 42 includes a clamp mechanism 54 mounted on cylindrical drum 44. The clamp mechanism 54 exerts a pulling tension on second end 52, as will be explained. The use of a tensioning means, such as clamp mechanism 54, to hold the donor sheet and receptor sheet in contact eliminates the need for a vacuum drum. As a result, apparatus 42 enables manufacture of a laser-induced thermal transfer printer with significantly less cost, size and complexity than existing printers.

Figure 3:
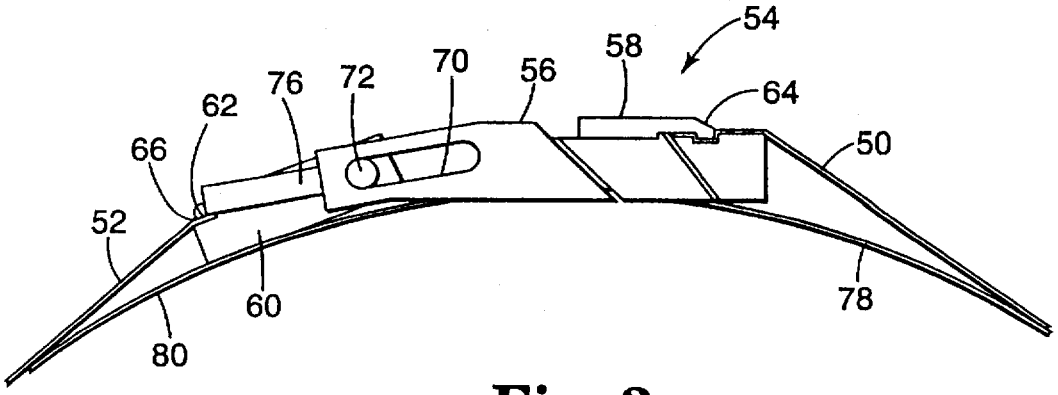
FIG. 3 is a side view of a tensioning mechanism for holding a donor sheet and a receptor sheet in contact with one another, in accordance with the present invention.
Figure 4:
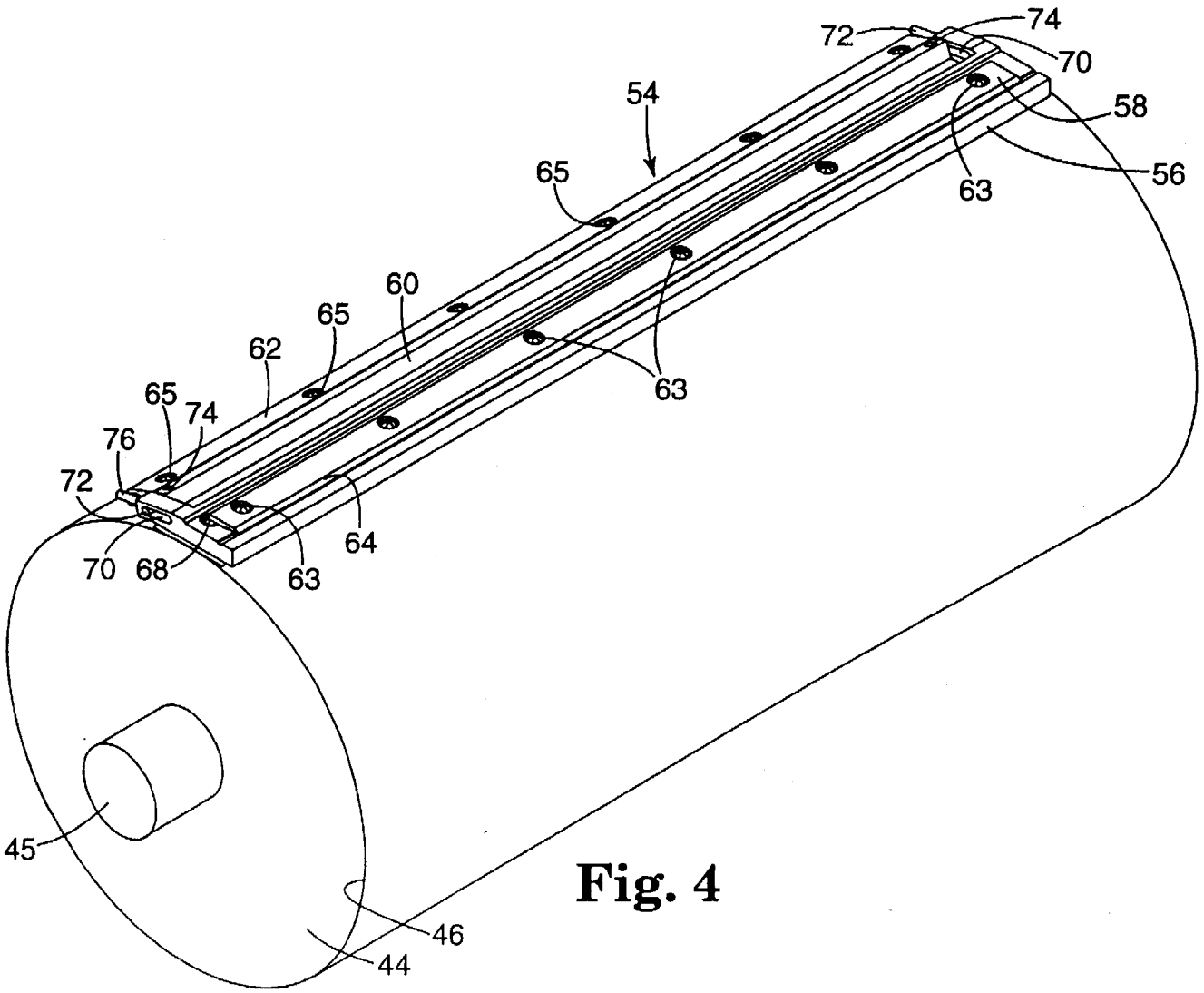
FIG. 4 is a perspective view of the apparatus of FIG. 2, in accordance with the present invention.
Figure 5:
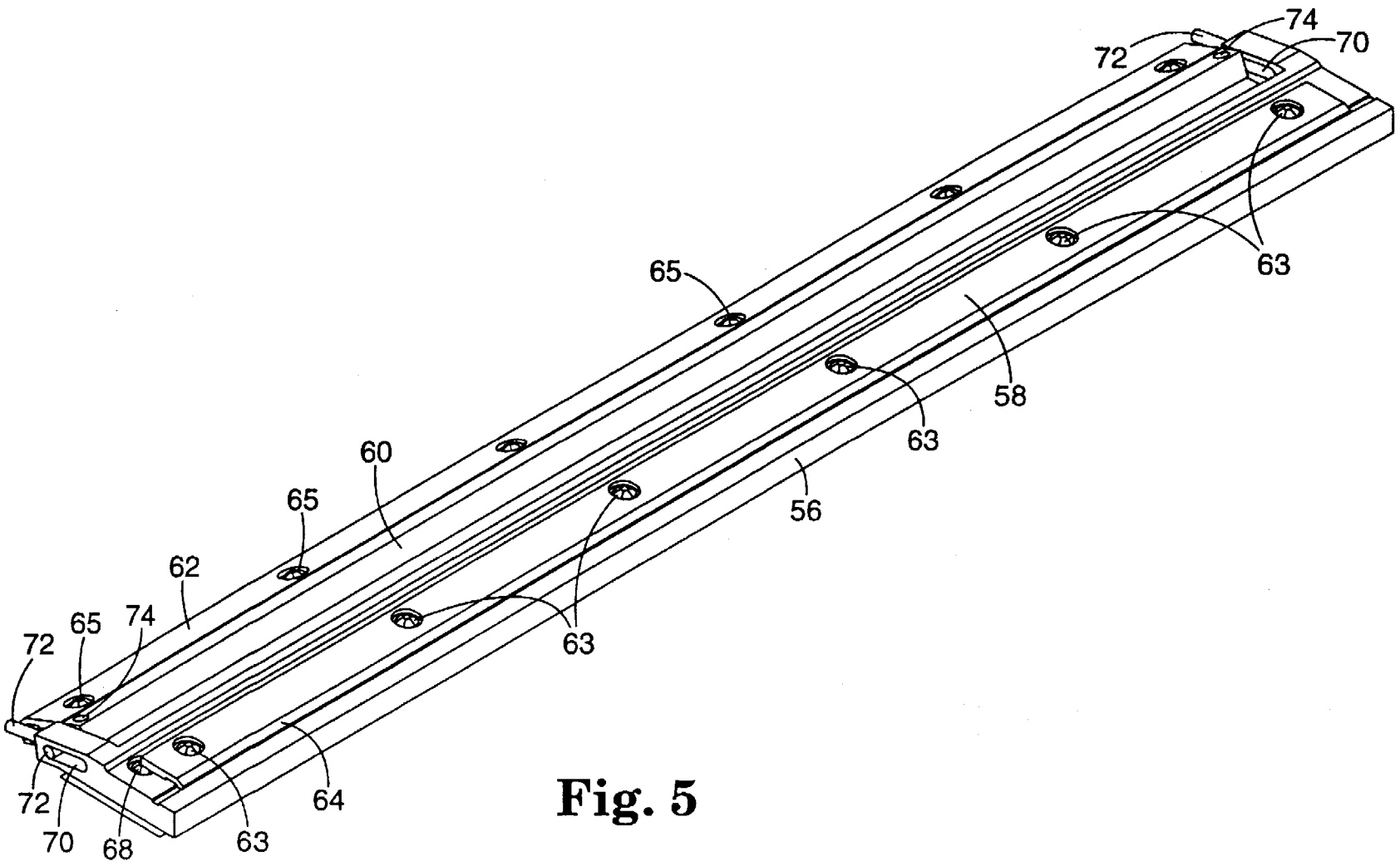
FIG. 5 is a perspective view of the tensioning mechanism of FIG. 3, in accordance with the present invention.
Figure 6:
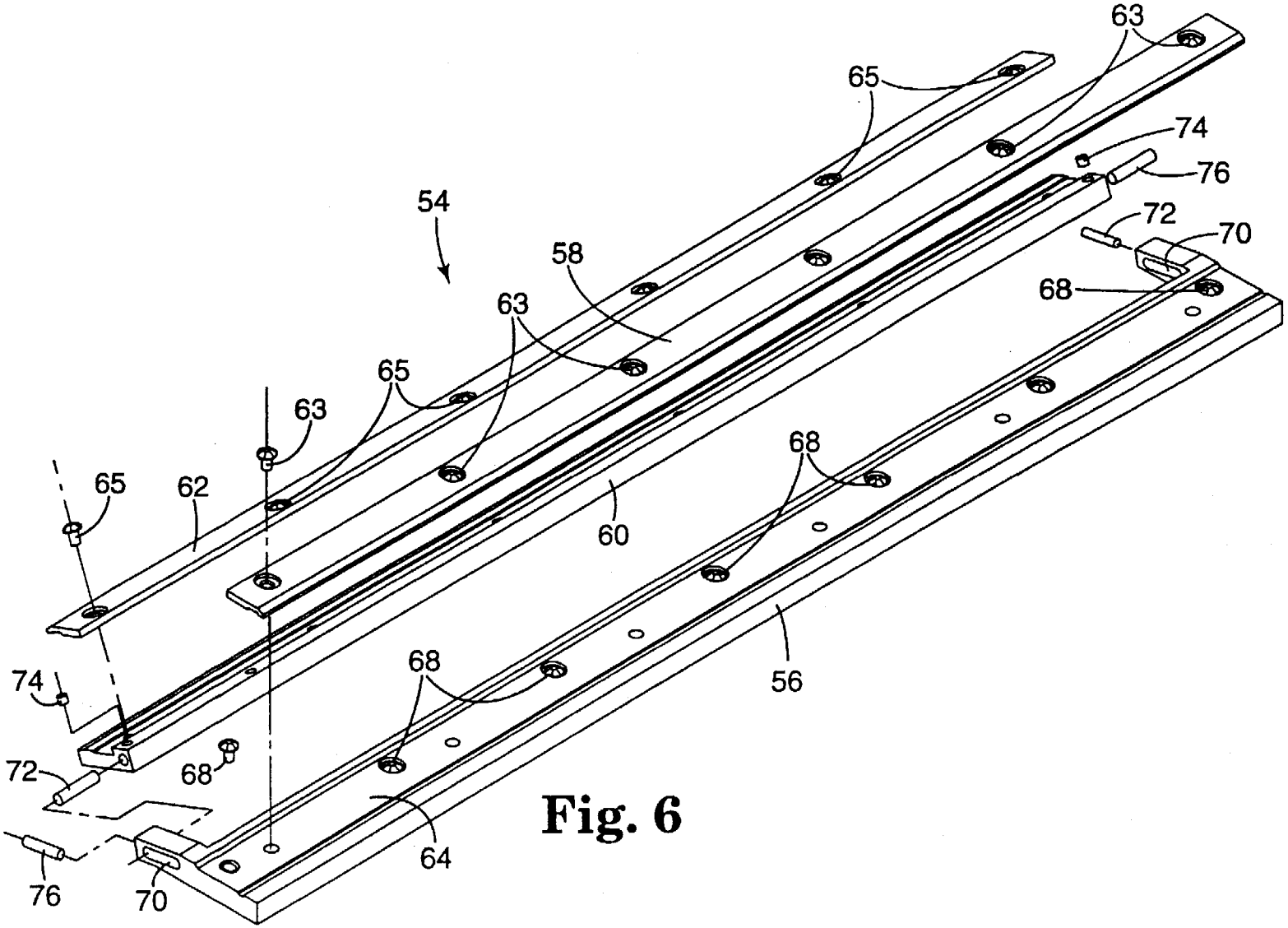
FIG. 6 is an exploded perspective view of the tensioning mechanism shown in FIGS. 3 and 5, in accordance with the present invention.

FIGS. 3–5 provide various additional views of clamp mechanism 54, both alone and in combination with cylindrical drum 44. With general reference to all of FIGS. 2–5, clamp mechanism 54 includes a first bottom clamping bar 56, a first top clamping bar 58, a second bottom clamping bar 60, and a second top clamping bar 62. As best shown in FIG. 4, the various clamping bars 56, 58, 60, 62 of clamp mechanism 54 extend across the circumferential surface of cylindrical drum 44, in a direction transverse to a direction of revolution of the drum.

The first bottom clamping bar 56 and first top clamping bar 58 are coupled to one another via a plurality of bolts 63, and together form a first clamp 64 for holding first end 50 of donor sheet 48. Similarly, second bottom clamping bar 60 and second top clamping bar 62 are coupled to one another via a plurality of bolts 65, and together form a second clamp 66 for holding second end 52 of donor sheet 48. The clamp mechanism 54 thereby mounts donor sheet 48 proximal to receptor sheet 46 about the circumferential surface of cylindrical drum 44. The first clamp 64 can be made to tightly grip first end 50 of donor sheet 48 by turning bolts 63. Bolts 65 also can be turned to cause second clamp 66 to tightly grip second end 52 of donor sheet 48.

The first clamp 64 and second clamp 66 are movable relative to one another. As best shown in FIGS. 4 and 5, first bottom clamping bar 56 is mounted in a fixed manner to cylindrical drum 44 via a plurality of bolts 68. However, second bottom clamping bar 60 is mounted on drum 44 in a movable manner. Specifically, first bottom clamping bar 56 has a slot 70 formed at opposite ends. A pair of pins 72, positioned at each end of second bottom clamping bar 60, are oriented to slide within slots 70, along the circumferential surface of drum 44 in a direction parallel to revolution of the drum. The pins 72 can be held within recesses in second bottom clamping bar 60 via set screws 74. A pair of adjustment screws 76 are mounted within first bottom clamping bar 56, in communication with slots 70. The adjustment screws 76 contact pins 72 within slots 70. By turning adjustment screws 76 to extend into slots 70, pins 72 can be made to move toward first bottom clamping bar 56 and first top clamping bar 58 within slots 70.

The movement of pins 72, in response to turning of adjustment screws 76, pulls second bottom clamping bar 60 and second top clamping bar 62 toward first bottom clamping bar 56 and first top clamping bar 58, thereby moving second clamp 66 toward first clamp 64. The movement of second clamp 66 toward first clamp 64 exerts tension on donor sheet 48, thereby drawing the donor sheet into contact with receptor sheet 46. Specifically, second clamp 66 applies a pulling tension to second end 52 of donor sheet 48 that acts across the entire width of the donor sheet. The pulling tension brings donor sheet 48 into contact with receptor sheet 46 with substantially uniform contact pressure.

The receptor sheet 46 could be mounted on cylindrical drum 44 with an adhesive, or with another clamping mechanism. The clamping mechanism 54 used for donor sheet 48 could be employed, however, to hold both the donor sheet and receptor sheet 46. For example, a first end 78 of receptor sheet 46 could be tightly held between the outer circumferential surface of cylindrical drum 44 and first bottom clamping bar 56, which is bolted to the drum. A second end 80 of receptor sheet 46 then could be held with a separate clamping bar mounted on drum 44 adjacent second bottom clamping bar 60. Alternatively, second end 80 of receptor sheet 46 could be left unclamped, with tensioned donor sheet 48 holding the second end against drum 44. With whatever clamping arrangement that is used, the various clamping bars should be balanced with drum 44 to prevent drum rotation speed variations.

The clamping mechanism 54 of FIGS. 2–5 is shown as a manual configuration. In other words, first and second clamps 64, 66 are tightened by manually turning bolts 63, 65, respectively, and tensioning is provided by manually turning adjustment screws 76. However, clamping mechanism 54 could be readily automated. For example, the clamping bars of each of first and second clamps 64, 66 could be spring loaded instead of bolted. The spring bias could be selected to provide either a normally closed or normally open position. With a normally closed spring bias, an automated lifting device, such as a solenoid, could be provided to open the clamp for receipt of donor sheet 48. With a normally open spring bias, a similar device could be provided to force the clamp closed, thereby holding donor sheet 48. For added automation, a feeding device could be provided to feed the ends of donor sheet 48 into clamps 64, 66 upon actuation of the clamping bars. The tensioning also could be automated, for example, by actuating pins 72 with solenoids instead of screws 76, or by a gear-driven mechanism that could gradually move second clamp 66 toward first clamp 64.

Having described the exemplary embodiments of the invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. An apparatus for providing contact between a donor sheet and a receptor sheet in a thermal transfer printer, the apparatus comprising:

a support for supporting a receptor sheet;

means for mounting a donor sheet proximal to said receptor sheet over said support; and means for applying tension to said donor sheet to draw said donor sheet into contact with said receptor sheet.

2. The apparatus of claim 1, wherein said means for applying said tension to said donor sheet includes means for applying a pulling tension to at least one of a first end of said donor sheet and a second end of said donor sheet.

3. The apparatus of claim 1, wherein said means for applying said tension to said donor sheet includes means for holding a first end of said donor sheet in a fixed position, and means for applying a pulling tension to a second end of said donor sheet.

4. The apparatus of claim 1, wherein said support includes a cylindrical drum, said receptor sheet being supported about a circumferential surface of said drum.

5. An apparatus for providing contact between a donor sheet and a receptor sheet in a thermal transfer printer, the apparatus comprising:

a support for supporting a receptor sheet; and a clamp mechanism mounted on said support, said clamp mechanism having a first clamp for holding a first end of a donor sheet and a second clamp for holding a second end of said donor sheet, wherein said clamp mechanism mounts said donor sheet proximal to said receptor sheet over said support, and wherein said first clamp holds said first end of said donor sheet in a fixed position, and said second clamp is movable to apply a pulling tension to said second end of said donor sheet, thereby drawing said donor sheet into contact with said receptor sheet.

6. The apparatus of claim 5, wherein said support includes a cylindrical drum, said receptor sheet being supported about a circumferential surface of said drum.

7. A method for providing contact between a donor sheet and a receptor sheet in a thermal transfer printer, the method comprising the steps of:

supporting a receptor sheet on a support;

mounting a donor sheet proximal to said receptor sheet over said support; and applying tension to said donor sheet to draw said donor sheet into contact with said receptor sheet.

8. The method of claim 7, wherein said step of applying said tension to said donor sheet includes the step of applying a pulling tension to at least one of a first end of said donor sheet and a second end of said donor sheet.

9. The method of claim 7, wherein said step of applying said tension to said donor sheet includes the step of holding a first end of said donor sheet in a fixed position, and the step of applying a pulling tension to a second end of said donor sheet.

10. The method of claim 7, wherein said support includes a cylindrical drum, said receptor sheet being supported about a circumferential surface of said drum.

11. A method for providing contact between a donor sheet and a receptor sheet in a thermal transfer printer, the method comprising the steps of:

supporting a receptor sheet with a support;

providing a clamp mechanism mounted on said support, said clamp mechanism having a first clamp and a second clamp;

holding a first end of said donor sheet with said first clamp;

holding a second end of said donor sheet with said second clamp, said clamp mechanism thereby mounting said donor sheet proximal to said receptor sheet over said support;

holding said first end of said donor sheet in a fixed position with said first clamp; and moving said second clamp to apply pulling tension to said donor sheet, thereby drawing said donor sheet into contact with said receptor sheet.

12. The method of claim 11, wherein said support includes a cylindrical drum, said receptor sheet being supported about a circumferential surface of said drum.

13. A laser-induced thermal transfer printer having an apparatus for providing contact between a donor sheet and a receptor sheet, the printer comprising:

a support for supporting a receptor sheet;

means for mounting a donor sheet proximal to said receptor sheet over said support;

means for applying tension to said donor sheet to draw said donor sheet into contact with said receptor sheet;

a laser for inducing thermal transfer of donor material from said donor sheet to said receptor sheet to form an image on said receptor sheet.

14. The printer of claim 13, wherein said means for applying said tension to said donor sheet includes means for applying a pulling tension to at least one of a first end of said donor sheet and a second end of said donor sheet.

15. The printer of claim 13, wherein said means for applying said tension to said donor sheet includes means for holding a first end of said donor sheet in a fixed position, and means for applying a pulling tension to a second end of said donor sheet.

16. The printer of claim 13, wherein said support includes a cylindrical drum, said receptor sheet being supported about a circumferential surface of said drum.

17. A laser-induced thermal transfer printer including an apparatus for providing contact between a donor sheet and a receptor sheet, the printer comprising:

a support for supporting a receptor sheet;

a clamp mechanism mounted on said support, said clamp mechanism having a first clamp for holding a first end of a donor sheet and a second clamp for holding a second end of said donor sheet, wherein said clamp mechanism mounts said donor sheet proximal to said receptor sheet over said support, and wherein said first clamp holds said first end of said donor sheet in a fixed position, and said second clamp is movable to apply a pulling tension to said second end of said donor sheet, thereby drawing said donor sheet into contact with said receptor sheet; and a laser for inducing thermal transfer of donor material from said donor sheet to said receptor sheet to form an image on said receptor sheet.

18. The printer of claim 17, wherein said support includes a cylindrical drum, said receptor sheet being supported about a circumferential surface of said drum.

19. An apparatus for providing contact between a donor sheet and a receptor sheet in a thermal transfer printer, the apparatus comprising:

a support for supporting a donor sheet;

means for mounting a receptor sheet proximal to said donor sheet over said support; and means for applying tension to said receptor sheet to draw said receptor sheet into contact with said donor sheet.

20. The apparatus of claim 19, wherein said means for applying said tension to said receptor sheet includes means for applying a pulling tension to at least one of a first end of said receptor sheet and a second end of said receptor sheet.

21. The apparatus of claim 19, wherein said means for applying said tension to said receptor sheet includes means for holding a first end of said receptor sheet in a fixed position, and means for applying a pulling tension to a second end of said receptor sheet.

22. The apparatus of claim 19, wherein said support includes a cylindrical drum, said receptor sheet being supported about a circumferential surface of said drum.

23. An apparatus for providing contact between a donor sheet and a receptor sheet in a thermal transfer printer, the apparatus comprising:

a cylindrical drum supporting a receptor sheet, the receptor sheet being supported about a circumferential surface of the drum; and a clamp mechanism holding a donor sheet proximal to the receptor sheet, the clamp mechanism applying tension to the donor sheet to draw the donor sheet into contact with the receptor sheet.

24. The apparatus of claim 23, wherein the clamp mechanism includes a first clamp for holding a first end of the donor sheet and a second clamp for holding a second end of the donor sheet, wherein at least one of the first clamp and second clamp is movable to apply a tension to the donor sheet, thereby drawing the donor sheet into contact with the receptor sheet.

25. An apparatus for providing contact between a donor sheet and a receptor sheet in a thermal transfer printer, the apparatus comprising:

a cylindrical drum supporting a receptor sheet, the receptor sheet being supported about a circumferential surface of the drum; and a vacuumless mechanism for holding a donor sheet proximal to the receptor sheet, the vacuumless mechanism applying tension to the donor sheet to draw the donor sheet into contact with the receptor sheet.

26. An apparatus for providing contact between a donor sheet and a receptor sheet in a thermal transfer printer, the apparatus comprising:

a support for supporting a receptor sheet;

means for mounting a donor sheet proximal to said receptor sheet over said support; and means for holding a first end of the donor sheet and a second end of the donor sheet, and moving at least one of the first end and second end of the donor sheet to apply tension to the donor sheet, thereby drawing the donor sheet into contact with the receptor sheet.

* * * * *